US012736055B2

(12) United States Patent
Huck

(10) Patent No.: US 12,736,055 B2
(45) Date of Patent: Sep. 15, 2026

(54) MODULAR DRY WELL PUMP STATION APPARATUS, SYSTEM AND METHOD

(71) Applicant: INDUSTRIAL FLOW SOLUTIONS OPERATING, LLC, New Haven, CT (US)

(72) Inventor: James M. Huck, Milford, CT (US)

(73) Assignee: INDUSTRIAL FLOW SOLUTIONS OPERATING, LLC, New Haven, CT (US)

( * ) Notice: Subject to any disclaimer, the term of this patent is extended or adjusted under 35 U.S.C. 154(b) by 0 days.

(21) Appl. No.: 18/067,723

(22) Filed: Dec. 19, 2022

(65) Prior Publication Data

US 2023/0120401 A1 Apr. 20, 2023

Related U.S. Application Data

(60) Provisional application No. 63/257,094, filed on Oct. 18, 2021.

(51) Int. Cl.
*F04D 13/12* (2006.01)
*F04D 7/00* (2006.01)
(Continued)

(52) U.S. Cl.
CPC ..... *F04D 13/12* (2013.01); *F04D 7/00* (2013.01); *F04D 13/10* (2013.01); *F04D 15/0022* (2013.01); *F04D 29/406* (2013.01)

(58) Field of Classification Search
None
See application file for complete search history.

(56) References Cited

U.S. PATENT DOCUMENTS 4,941,808 A 7/1990 Qureshi et al.
5,037,737 A 8/1991 Liffmann et al.
(Continued)

FOREIGN PATENT DOCUMENTS

AU 2016101769 A4 11/2016
CN 202558695 U 11/2012
(Continued)

OTHER PUBLICATIONS

"Operator's Desire", YouTube video, dated Sep. 25, 2019, "https://www.youtube.com/watch?v=b7xs8yoNOIQ".*
(Continued)

*Primary Examiner* — Robert K Arundale
(74) *Attorney, Agent, or Firm* — Wasserbauer Law, LLC; Damian G. Wasserbauer, Esq.; Nicholas E. Blanton, Esq.

(57) ABSTRACT

A pump station is disclosed for pumping a Flow $F_i$ in pipes of a gravity feed network having a pumping system located in said dry well chamber, said pumping station comprising controls, motors, pumps and assembly and branched piping $P_B$ operably connected to one or more pumps, and with an inlet piping $P_2$ operably connecting a first flow $F_1$ from a gravity feed piping network, and with an outlet piping $P_3$ operably connected to the output of the branched piping $P_s$ and/or the one or more pumps. Additionally disclosed is an outlet piping $P_3$ operably connected to the output of said branched piping $P_s$ and/or said one or more pumps, and with a return piping Ps operably connected to said inlet piping P2 and/or output piping Pg of a sump pump.

4 Claims, 4 Drawing Sheets

(51) Int. Cl.

| | |
|---|---|
| ***F04D 13/10*** | (2006.01) |
| ***F04D 15/00*** | (2006.01) |
| ***F04D 29/40*** | (2006.01) |

(56) References Cited

U.S. PATENT DOCUMENTS

| | | | |
|---|---|---|---|
| 5,755,965 | A | 5/1998 | Reiber |
| 5,980,613 | A | 11/1999 | Reiber |
| 6,387,264 | B1 | 5/2002 | Baur |
| 6,472,851 | B2 | 10/2002 | Hammond |
| 6,564,579 | B1 | 5/2003 | Mccartney |
| 6,652,757 | B2 | 11/2003 | Hodges et al. |
| 7,160,457 | B2 | 1/2007 | Wells et al. |
| 7,285,215 | B2 | 10/2007 | Barnard |
| 7,392,767 | B2 | 7/2008 | Franklin et al. |
| 7,799,178 | B2 | 9/2010 | Eddington |
| 8,066,023 | B2 | 11/2011 | Hoffart |
| 8,328,995 | B2 | 12/2012 | Eddington |
| 8,444,943 | B2 | 5/2013 | Lamar |
| 8,650,906 | B2 | 2/2014 | Price et al. |
| 8,984,854 | B2 | 3/2015 | Rosse |
| 9,242,065 | B2 | 1/2016 | Hunt et al. |
| 9,243,842 | B2 | 1/2016 | Price |
| 9,956,523 | B2 | 5/2018 | Colley et al. |
| 10,144,892 | B2 | 12/2018 | Kosler et al. |
| 10,436,505 | B2 | 10/2019 | Jiang et al. |
| 10,726,512 | B2 | 7/2020 | Koch et al. |
| 10,975,990 | B2 | 4/2021 | Plattsmier et al. |
| 2008/0307799 | A1 | 12/2008 | Rosetta et al. |
| 2013/0213087 | A1 | 8/2013 | Currence |
| 2016/0061516 | A1 | 3/2016 | Seitter et al. |
| 2017/0130956 | A1 | 5/2017 | Gray et al. |
| 2018/0112367 | A1 | 4/2018 | Seeger et al. |
| 2019/0112774 | A1 | 4/2019 | Kosler et al. |
| 2020/0002201 | A1 | 1/2020 | Stinson et al. |

FOREIGN PATENT DOCUMENTS

| | | | |
|---|---|---|---|
| CN | 203174745 | U | 9/2013 |
| CN | 101384323 | B | 12/2013 |
| CN | 104192995 | A | 12/2014 |
| CN | 105756913 | A | 7/2016 |
| CN | 205714700 | U | 11/2016 |
| CN | 205975699 | U | 2/2017 |
| DE | 3340905 | A1 | 5/1985 |
| KR | 1020060075618 | A | 7/2006 |
| KR | 1020100029640 | A | 3/2010 |
| KR | 101609841 | B1 | 3/2016 |
| KR | 1020190028974 | A | 3/2019 |
| KR | 1020200036308 | A | 4/2020 |
| TW | 201604405 | A | 2/2016 |

OTHER PUBLICATIONS

"SIDE Industrie presents the DIP Systeme and the DIP Booster (subtitled)", YouTube video, dated May 24, 2019, https://www.youtube.com/watch?v=ZBHvX-IIwhE.

"Présentation du SIDINOX 3D: Sidinox Lift In-line Station", YouTube video, dated Apr. 23, 2020, https://www.youtube.com/watch?v=qBy98NCetmA.

* cited by examiner

MODULAR DRY WELL PUMP STATION APPARATUS, SYSTEM AND METHOD

CROSS-REFERENCE TO RELATED APPLICATION(S)

This U.S. non-provisional patent application claims priority to U.S. Provisional Patent Application No. 63/257,094 filed 18 Oct. 2021, and entitled "MODULAR DRY WELL PUMP STATION APPARATUS, SYSTEM AND METHOD," the entire disclosure of which is hereby incorporated by reference.

TECHNICAL FIELD

The present invention relates to a modular pre-assembled dry well pump station apparatus, system and method for replacement and/or retrofit of a pump station utilizing wet well that improves worker safety for personnel, conditions for maintenance crews and reduces environmental impact.

BACKGROUND

Pumping stations are facilities having pumps and equipment for pumping fluids from one place to another used for a variety of infrastructure systems to process a supply of water from canals, drainage of low-lying land, wastewater, and sanitary sewer systems. Sanitary sewer systems are constructed to collect and transport domestic, commercial, and industrial wastewater and limited amounts of stormwater and infiltrated ground water to treatment facilities for appropriate treatment. When stormwaters or power outages overwhelm sanitary sewer systems these pumping stations can fail and refurbishment or upgrading the capacity is needed to maintain the removal of sewage to a processing site such as a water treatment facility for appropriate treatment.

Conventional pumping stations are designed as a building or wet well for the collection of fluids like surface water, wastewater or sewage where drainage therein is mainly by gravity. Conventional pumping stations are expensive to construct, maintain, and operate and suffer from disadvantages including costs associated with capital, operation, maintenance, and skilled personnel. Decisions on whether to install a new pump station include factors such as topography, excavation, elevations, and capacity of existing water distribution and treatment systems or sewage collection and treatments systems as well as existing building code restrictions for catastrophic events such as environmental rainstorms and interruptions of power. Additional problems include odor or noise and other adverse aesthetic effects. Therefore, there is a long felt need to reduce these factors, and others, to minimize costs.

Local factors and municipal codes directly affect the size of a wet well so as to hold a desired volume of wastewater as calculated using variables specified by the town, county, or State to avoid sewage backups in an emergency, high flow, or pump failure conditions, and also calculating requirements to clear or otherwise pump out the collected fluids at a future time. While wet wells can provide a reduction in the risk of unwanted sewage discharge, wet wells suffer from disadvantages of gas buildup, odor emittance, and/or failed pumping due to items clogging pumps or other mechanical failures. Wet wells also can be dangerous places for those who work in and around these environments due to the buildup of gases that can cause serious injury or death such as, for example, methane and hydrogen sulfide emitted from the breakdown of organic matter or other industrial activities. Consequently, there is a need for a solution to improve safety, pump performance, and to reduce exposure to dangerous gases during normal operation, and to control release of these gases to the atmosphere in emergency flow situations so as.

Existing wet well pumping stations are typically limited in a number of other ways, such as, for example, having:

- Insufficient flow, or insufficient capacity for future demand of increased flow
- a limited physical space within the existing pump station to house pumps and other appurtenances;
- limited options for piping for suction and discharge as these may not be of a large enough diameter to accommodate increased flow; and
- limitations for enlarging the building at a future time.

Additionally, conventional pumping stations use a configuration of a wet well enclosure with submersible sewage pumps submerged within the sewage. These submersible pumps require use tracks or other mounts for maintenance or replacement of the submersible pumps, for example, by raised to normally ground for maintenance level using a chain or guide rails. Therefore, there is a long felt need to provide increased flow to ensure effective installation, operation, and maintenance, while minimizing associated costs.

Consequently, there is a long felt need to provide an improved pump station that can reduce health and safety factors, have a smaller footprint and visibility, and configured to replace a conventional pump station and/or specifically, to refit a wet well pumping station. A need exists for a modular dry well pump station for refitting and/or refurbishment that can be accomplished by installing, or merging it, with the wet well so as to function as a dry well in normal operations, emergencies, and power failures. Therefore, there is a long felt need to provide such a solution to existing wet well designs when retrofitting wet wells using submersible pumps that provides increased flow to ensure effective installation, operation, and simplified and easier maintenance thereof.

BRIEF DESCRIPTION OF THE DRAWINGS

Non-limiting and non-exhaustive embodiments of the present disclosure are described with reference to the following drawings. In the drawings, like reference numerals refer to like parts throughout the various figures unless otherwise specified.

For a better understanding of the present disclosure, reference will be made to the following Description of the Embodiments, which is to be read in association with the accompanying drawings, which are incorporated in and constitute a part of this specification, show certain aspects of the subject matter disclosed herein and, together with the description, help explain some of the principles associated with the disclosed implementations, wherein.

DESCRIPTION OF THE EMBODIMENTS

Figure 1:
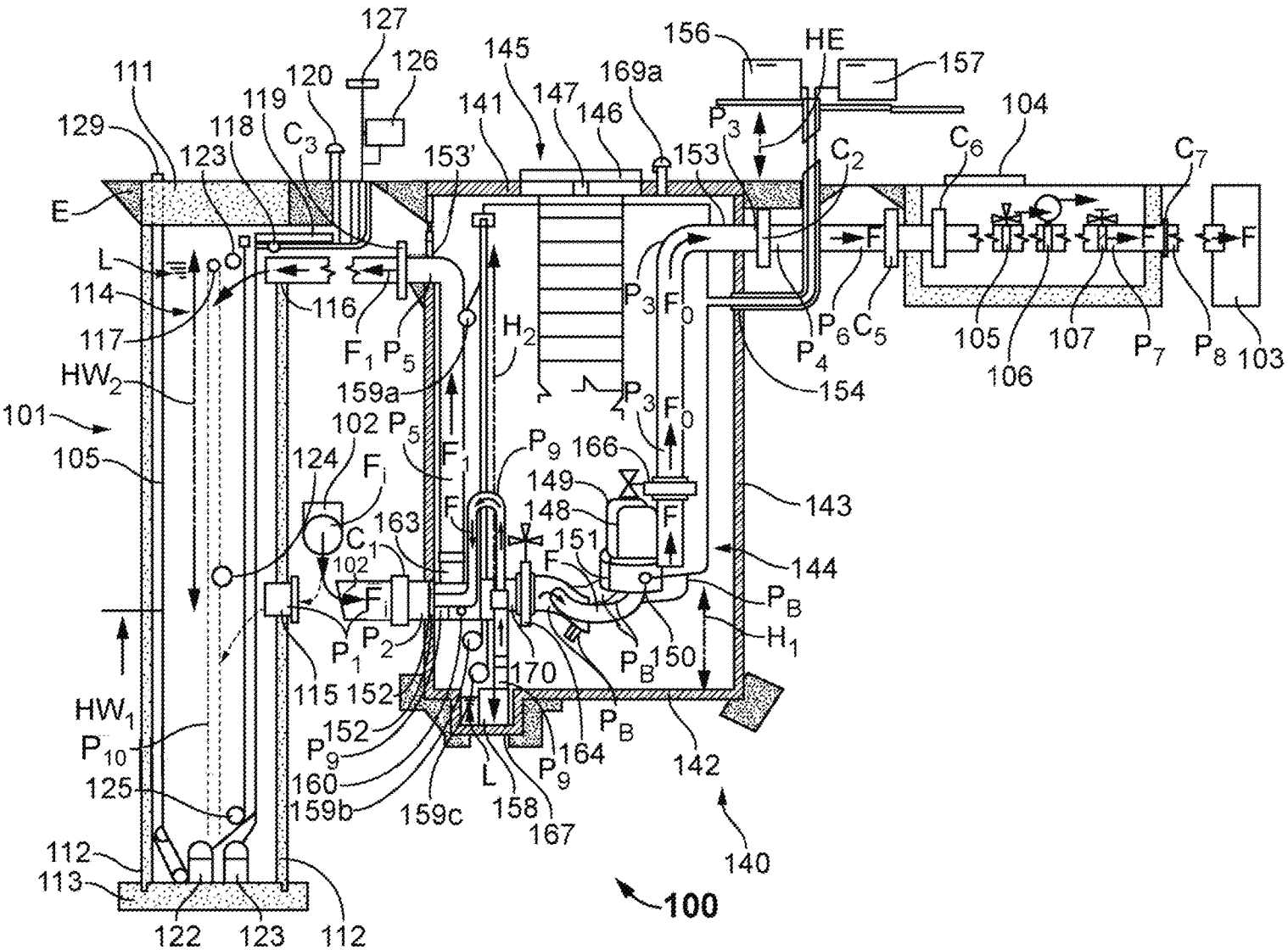
FIG. 1 is a schematic view of a modular dry well pump station apparatus, system, and method, in accordance with an embodiment of the present disclosure.

Non-limiting embodiments of the invention will be described below with reference to the accompanying drawings, wherein like reference numerals represent like elements throughout. While the invention has been described in detail with respect to the preferred embodiments thereof, it will be appreciated that upon reading and understanding of the foregoing, certain variations to the preferred embodiments will become apparent, which variations are nonetheless within the spirit and scope of the invention.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "some embodiments", "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; Band C; A, Band C". An exception to this definition will occur only when a combination of elements, functions, steps or acts are in some way inherently mutually exclusive.

The term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

FIG. 1 is provided to disclose the invention and to illustrate the features of the present invention, and is not to be considered as a limitation thereto. The invention is described in an embodiment of a pump station for sewage collection systems designed to handle raw sewage that is fed from underground gravity flow pipes and/or pipelines whereby sewage is fed into and stored in a pit, commonly known as a wet well, equipped with sensors, floats and/or electrical instrumentation to detect the level of sewage present. For example, when the sewage level rises to a predetermined point, a pump will be started to lift the sewage upward through a lift station, a pressurized pipe system, and/or a sewer force main for transport and/or discharge. Once the wet well decreases below the predetermined level, the pumps are turned off. This cycle repeats, e.g. starts all over again, until the sewage is moved to higher elevations or reaches its point of destination-usually a treatment plant. The storage volume of the wet well between the "pump on" and "pump off" settings is designed to minimize pump starts and stops, so as to not allow the sewage to go septic, to control the utilization rate of the pumps for efficient use of energy and longevity, and to manage remote control of the operation of the dry well system.

During adverse environmental and heavy rainwater conditions, high sewage flows into the well and additional pumps will be used during these peak flow and wet weather periods. If this is insufficient, or in the case of failure of the pumping station, a backup in the sewer system can occur, leading to the disadvantage that a sanitary sewer overflow—the discharge of raw sewage into the environment occurs or has an unacceptable a retention time so as to allow the sewage in the wet well to go septic. Then interior of a sewage pump station becomes a very dangerous place as poisonous gases, such as methane and hydrogen sulfide, accumulate in the wet well and an ill-equipped person entering the well would be overcome by fumes very quickly. Safe entry into the hazardous environment of wet well requires the correct equipment and method of entry to this confined space. Once these and other failures occur, a disadvantage of conventional systems is that the pump station the solution is new construction of a larger capacity wet well so as to handle the new desired flow. Consequently, a sewage network provides sanitary conditions using one or more sewer and/or combined sewer systems to collect and transport domestic, commercial, industrial wastewater, limited amounts of stormwater, and infiltrated ground water to treatment facilities for appropriate treatment. Sanitary sewers are different than combined sewers, which are designed to collect large volumes of stormwater in addition to sewage and industrial wastewater. Occasionally, sanitary sewers will release raw sewage. These types of releases are called sanitary sewer overflows (SSOs). SSOs can contaminate waters, causing serious water quality problems, back-up into homes, cause property damage, and threaten public health.

Referring to FIG. 1, the modular dry well pump station apparatus, system and method, designated as element 100, may be joined or otherwise operably connected to existing piping and network infrastructure such as a wet well 101 in a gravity feed piping network 102 supplying sewage to a treatment plant.

The wet well 101 may comprise an enclosure 110 with a cover 111, surrounding wall(s) and/or sides 112, and a base 113. A void or chamber 114 is formed by the inner space of the cover 111, surrounding walls 112, and base 113. The surrounding walls 112 include an inlet opening 115, one or more outlet openings 116 and 117, or a formed opening 118, an opening 119 for wires and other electrical control connections, and an opening for a vent 120. The enclosure 110 is configured with the vent 120 for releasing unwanted harmful gases that is operably connected to the chamber 114 through the vent opening 119. The inlet opening 115 is configured to receive an inlet pipe $P_1$ to deposit input Liquid(s), denoted as L, into the chamber 114. One or more outflow openings 116 and 117 are configured to receive piping $P_{10}$ (shown in dashed lines) connected to one or more submersible pumps 121, 122 located at a base 113 of the enclosure 110. The outflow, denoted $F_2$ as in FIG. 2, of the submersible pumps 121, 122 exits the enclosure 110 through the one or more outflow openings 116 and 117 located at the upper portion of the wet well 101. The pumping of Liquid L from the chamber 114 may be controlled by one or more floats or other sensors that energize one or more of the submersible pumps 121, 122 based on settings for predetermined levels of Liquid L such as, for example, upper level float 123, e.g. a start float set at the maximum level, input opening level float 124, e.g. one or more intermediate floats useful in controlling the cycling of the submersible pumps for efficient operation; and lower level float 125, e.g., a stop float set to a minimum level. In operation, a controller 126 and source of power 127 receive input from the floats 123, 124, and 125 or other sensors so as to energize one or more of the submersible pump 121, 122 to drain the wet well 101 in a controlled manner.

Figure 2:
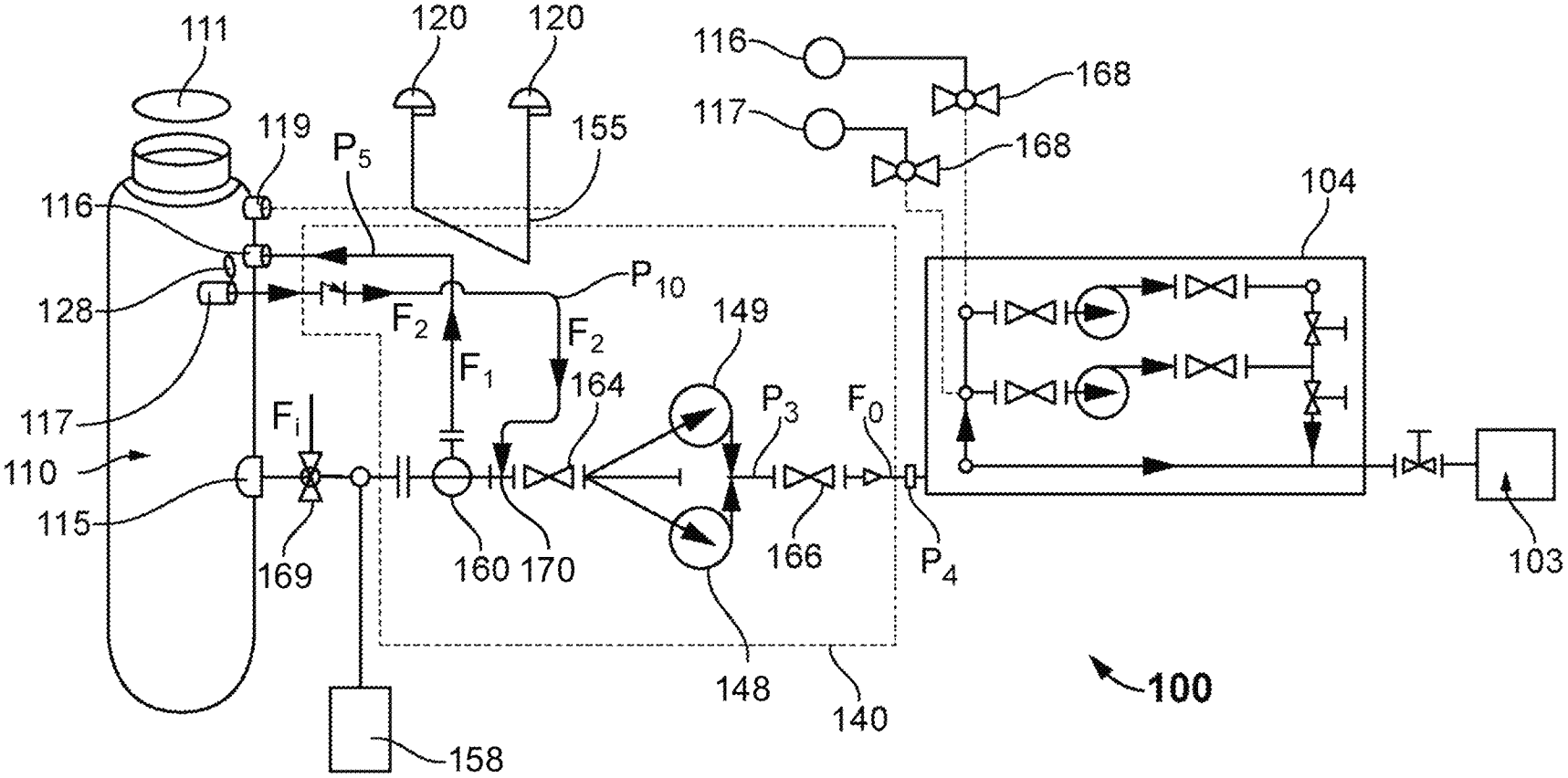
FIG. 2 is a schematic view of the valves and connections between a modular dry well pump station apparatus, system, and a wet well in the refurbishment thereof, in accordance with an embodiment of the present disclosure.

As shown in FIGS. 1 and 2, the modular dry well pump station 100, sometimes referred to as a Packaged Lift Stations (PLS), can be a new installation as well as may be utilized for replacement of a wet well 101. The dry well pump station 100 comprises an enclosure 140 formed in a contiguous shape having an upper portion 141, lower portion 142, at least one side portion 143 such as, for example, a circular side portion 143, so as to form an interior void or dry well chamber 144. The upper portion 141 may be configured with a hatch assembly 145 with a hinge 146 and a ladder 148 to seal the enclosure 140 from the elements as well as to provide access to the dry well chamber 144. The hatch assembly 145 can include a seal to make the dry-well chamber 144 water resistant or otherwise to stop entry of unwanted water, flooding conditions, and the like.

The side portion 143 of the modular enclosure 140 is configured with one or more openings for piping, telemetry and venting. The side portion 143 is configured with an inlet opening 152 dimensioned to receive flow $F_i$ of the gravity feed piping network 102 in the inlet piping $P_2$, thereby operably disconnecting flow $F_i$ from the wet well outlet port piping $P_1$. Inlet piping $P_2$ operably connects flow $F_i$ to the interior space of the dry well chamber 140 of the pump station 100, whereby piping 102 and piping $P_2$ may be configured to connect via flanges. In an alternative embodiment of the modular dry well pump station 100, a diverter valve 160 may be located between the gravity feed piping network 102 and both piping $P_1$ and piping $P_2$ so as to divert flow $F_i$ in a first mode to the dry well chamber 140 for processing by the pumping system, or in a second mode to piping $P_1$ to input flow $F_i$ into the wet well 101 for storage and later processing, as desired.

The side portion 143 furthermore has one or more outlet opening(s) 153 at an elevation and/or height above inlet piping $P_2$ and/or input flow $F_i$. At least one outlet opening 153 is dimensioned to receive downstream and/or outflow $F_o$ via piping $P_3$. The outlet opening 153 is elevated and/or at height above inlet piping $P_2$ and/or input flow $F_i$ so as to send out the outflow $F_o$ generated by the pumps 148, 149 of the dry well pumping system via an operable connection with piping $P_3$. Another outlet opening 153' is operably connected to inlet piping $P_2$ and similarly is elevated and/or located at a height above inlet piping $P_2$. Outlet opening 153' provides a return flow path, denoted as $F_1$ as in FIG. 1, to the wet well via a operable connection between piping $P_5$ and piping $P_2$, typically forward to the gate valve, whereby diversion of input flow $F_i$ is provided when conditions exceed the maximum flow processing rate regarding the pumping system, pressure, and/or other system maintenance conditions, for example, a portion and/or all of input flow $F_i$ present at inlet piping $P_2$ can be diverted to the wet well for later processing, for system maintenance, or for processing fluids from the sump well.

The modular enclosure 140 has telemetry opening 154 adapted for power, wires, cables, communication, and providing an electrical circuit connection to a power source 156, a control unit 157, and/or other electronic devices with such devices being elevated at a Height HC above the location of the dry well pump station system. The Height HC can be determined from various factors and data such as, for example, the environment for the desired installation, data regarding the particular wet well system & revisions thereto, the gravity network design & connecting thereto, topography, and historical information e.g., the 100 year high flood recorded height above the earth E for the desired installation location.

The modular dry well pump station system 100 may further have an opening 155 for one or more vents 120. The vent is configured to control venting of dangerous gasses, contaminants, viruses and the like from the interior of the dry well chamber 144 advantageously to provide improved safety in septic and groundwater applications. In addition, the very operation of a wet well 101 has disadvantages from reaching a prescribed fill level before pumping creating septic standing water, releasing odors that put people, maintenance workers, and the environment in danger. There are problems to be solved when an aging wet well 101 basin that has, or may have, cracking and/or is leaking harmful contaminants into the surrounding soil including cost, laws, regulations & other governmental restrictions, the location is not suitable for a wet well such that an aging wet well 101 may not be allowed. Advantageously, the self-contained modular dry well pump station system 100 directly connecting to the gravity feed piping network 102 is a solution to replace and/or retrofit a wet well 101 because it is not required or needed when supplying sewage to a treatment plant. Consequently, the wet well may be removed, capped off, and/or may be used for a first flow $F_1$ as described herein.

The dry well pump station system 100 can further include a sump pump 158, and one or more floats 159, e.g., upper float 159*a*, lower float 159*b*, and sump well float 159*c* located in a sump well 167 formed integral to the lower portion 142 of the dry well enclosure 140 as may be needed to process a flooded condition, spills, accumulated fats, oils, greases (FOG), solids, and fibrous debris. The sump pump 158 outlet opening 153' is operably connected to inlet piping $P_2$ and similarly is elevated and/or located at a height above inlet piping $P_2$. Outlet opening 153' provides a return flow path, such as first flow $F_1$ to the wet well and/or other processing system via a operable connection between piping $P_5$ and piping $P_2$, typically forward of the gate valve to pump fluids from the sump well 167. If the dry well pump station system 100 floods the floats 159*a*, 159*b*, 159*c* can operably clear or dry well chamber 144 of liquids and/or water. If the wet well 101 is not able to accept water, diversion of input flow $F_i$ advantageously is provided when conditions exceed the maximum flow processing rate regarding the pumping system, pressure, and/or other system maintenance conditions, for example, a portion and/or all of input flow $F_i$ present at inlet piping $P_2$ can be diverted to the wet well for later processing, for system maintenance, or for processing fluids from the sump well.

Figure 3:
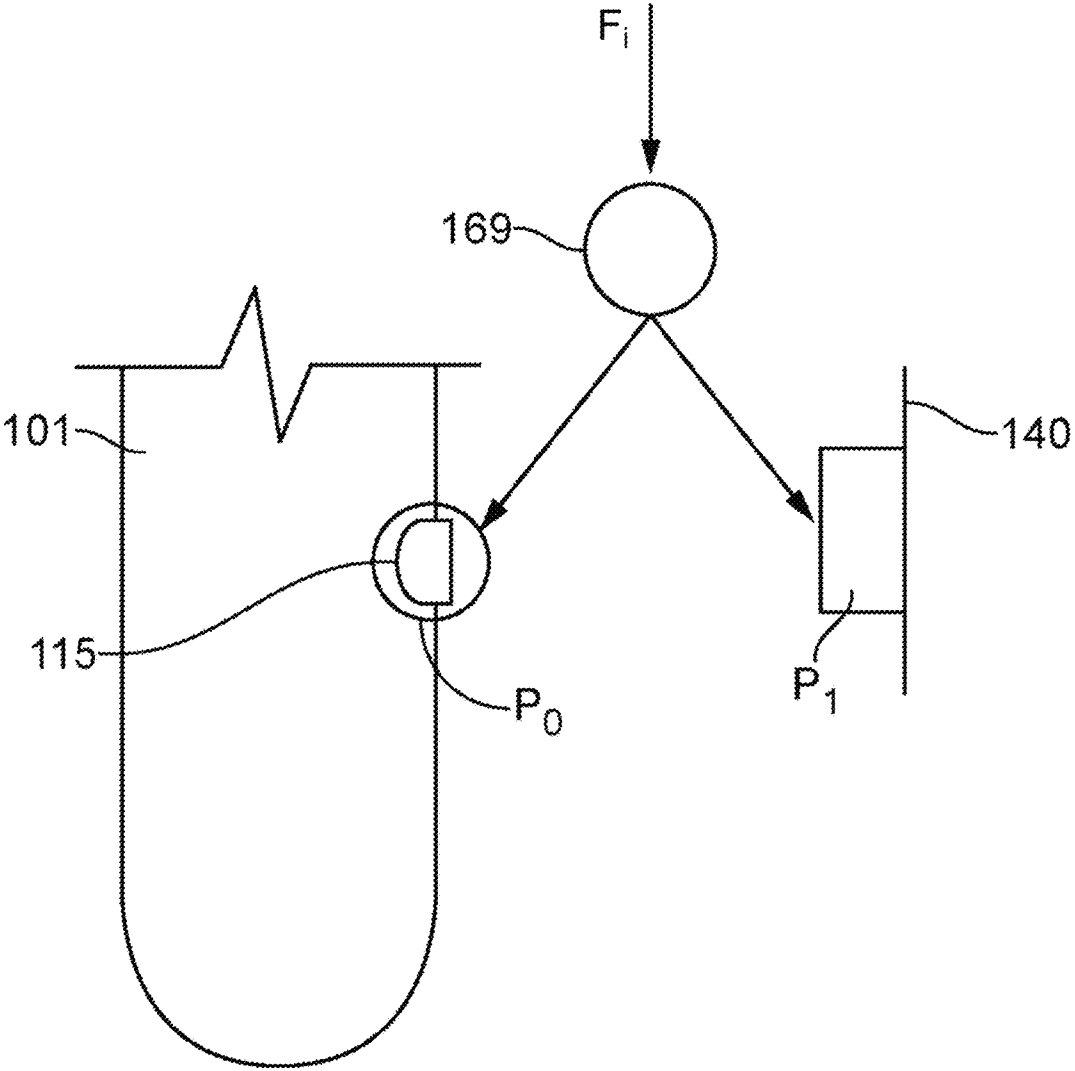
FIG. 3 is a schematic view of the valves and connections in the modular dry well pump station apparatus, system, and method according to another embodiment of the present disclosure.

In the replacement or upgrading of the wet well 101 to the dry well pump station system and method 100, the wet well 101 enclosure 110 is utilized with the inlet opening 115 and/or piping $P_0$ into the chamber 114 closed, e.g., capped, as shown in FIG. 3. The dry well pump station system 100 connects piping $P_2$ to piping P1, that may be joined by a collar $C_1$, so as to direct input flow Fr into the modular enclosure 140 from the gravity feed piping network 102, e.g., sewage network 102, is connected to the direct pumping station system 100 via into piping $P_2$. Piping $P_2$ is operably connects flow $F_i$ directly to the one or more pumps 148, 149 through one or more piping branches $P_B$ that joins to piping $P_3$ after the volutes 150, 151, e.g., combining the outflow $F_o$ into one pipe of Piping $P_3$. The one or more pumps 148, 149 are configured to generate outflow $F_o$ to the elevated level of piping $P_4$ with a connection made between piping $P_3$ piping and $P_4$ via a collar $C_2$ or by flanges thereon.

A diverter valve 160 can be connected between the piping $P_2$ and one or more pumps 148, 149 directly, or having a gate valve 164 placed between the input 165 to the pumps and a branched connector body 170, whereby the upstream gate valve 164 can close the input flow $F_i$ from the pump input as desired for servicing and maintenance. The diverter valve 160 comprises a diverter outlet channel 163 extending from the diverter valve body 161 that is adapted to connect to piping $P_5$ for the first flow $F_1$ to the existing wet well 101. The diverter valve 160 is located upstream or before the one or more reversible chopper pumps 148, 149. Another downstream gate valve 166 can be located downstream of the volutes 150, 151 of the one or more pumps 148, 149, whereby the downstream stream gate valve 166 can close the outflow $F_o$ from the pump outlet as desired for servicing and maintenance. Piping $P_3$ is dimensioned to pass through an outlet opening 153 formed in the modular enclosure 140 of the system 100. Alternatively, one or more exit openings 154 may be formed so as to accommodate Piping $P_3$ connecting outflow $F_o$ from the output of multiple pumping units as may be desired in larger installations. In this manner, the outflow $F_o$ may be operably connected to other downstream network structures such as, for example, to a vault 104 housing via piping $P_6$, e.g., valves for control, isolation or maintenance, to a pumping sub-station, and/or otherwise downstream, onward via piping $P_7$ to the treatment plant 103 for processing the sewage, as shown in FIGS. 1 and 2.

Figure 4:
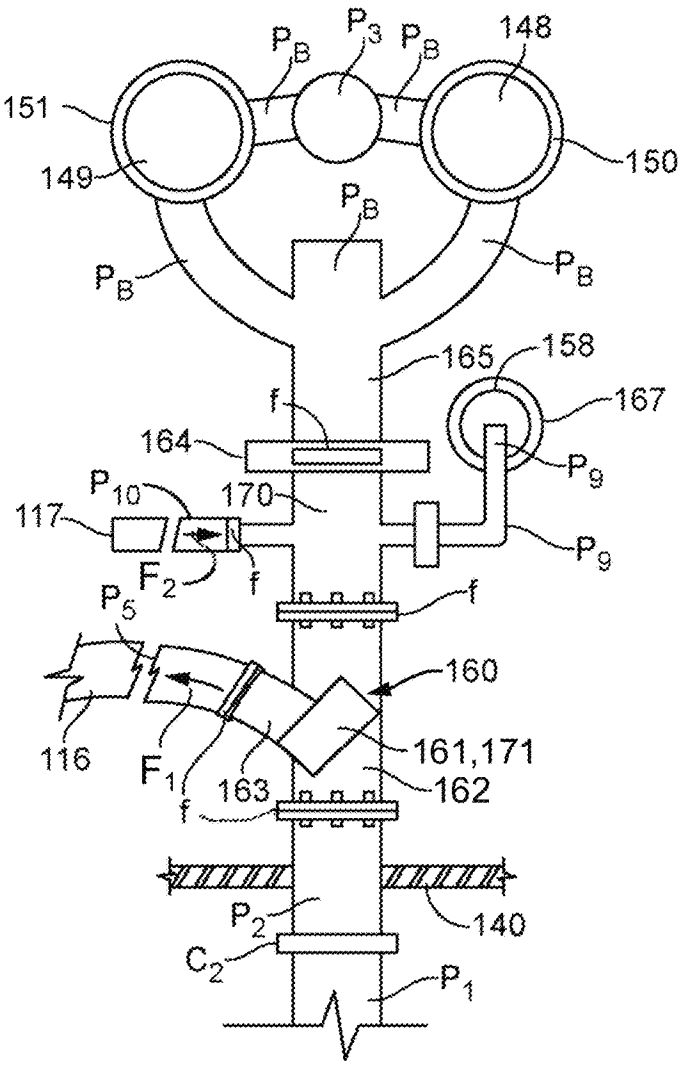
FIG. 4 is a top schematic view of the diverter valve and branched connections in the modular dry well pump station apparatus, system, and method according yet another embodiment of the present disclosure.

As is illustrated in FIGS. 1-4, the diverter valve 160 comprises a body 161 having a primary inlet channel 162 for a connection for the input flow $F_i$ by a connection, e.g. flanged, denoted as f as in FIG. 4, between $P_2$ and the branched connector body 170, and a diverter outlet channel 163 for directing the input flow $F_i$ in piping $P_2$ into piping $P_5$, also as shown in FIG. 4. A suitable orientation locates the diverter outlet channel 163 in a downward position so as to utilize gravitational forces on the input flow $F_i$ in piping $P_5$. A suitable diverter valve is configured to actuate upon a loss of power, e.g. a solenoid 171 actuated diverter valve, to divert input flow $F_i$ in controlled manner to the branch of piping $P_5$ and terminating into the wet well 101, designated as first flow $F_i$ in FIGS. 1, 2 and 4. It is advantageous that such flow is diverted during a power outage, or an emergency event, so as to safeguard residents on the sewage network 103 against overflowing piping in their structures. Consequently, the novel method provides a fail-safe controlled mode with a dry well pump station system 100 during a power loss that results in input flow $F_i$ being diverted from the primary inlet channel 162 by an internal valve once held open by the solenoid 171 and now closed, thereby automatically opening diverter output channel 163 and maintaining first flow $F_1$ as shown in FIGS. 1, 2 and 4.

Upon a power restore, the energized solenoid 171 opens the primary inlet channel 162 closing the diverter output channel 163. Moreover, the submerged pump 122 can be engaged by the float switches 123, 124, 125 to return first flow $F_1$ as second flow $F_2$ through the outlet 117, or a newly formed opening 128, branch via piping $P_{10}$ terminating in the branched connector body 170. The novel method returns liquids L from the wet well 101 for processing by the one or more pumps 148 and/or 149 as second flow $F_2$. While the submersible pump 122 may be self-operational, drawing power from a power unit 156, the control unit 157 may be connected for remote monitoring of second flow $F_2$ via piping $P_{10}$ reconnecting outflows from the submersible pumps to piping $P_{10}$ such as with a check valve as shown in FIGS. 1 and 2.

Certain structures of the wet well 101 can be maintained under the control unit 157 of the dry well pump station apparatus, system 100 such that Liquid L now present in the wet well 101 can be pumped back through the diverter valve 150, under control of the control unit 157, by coordinated integration of the floats 123, 124, 125, and coordinated and having the diverter valve 160 controllably maintained in the closed position to send input flow $F_i$ to the pumping station system for processing of the Liquid L. The diverter valve 160 can be configured as a solenoid, pressure, or other diverter valve operating in an open position having input flow $F_i$ in piping $P_2$ and upon a power failure, the diverter valve closes input flow $F_i$ in piping $P_2$ to a closed position and directs the input flow F, into the branch of piping $P_5$. This branch of piping $P_5$ can connect piping $P_5$ from the dry well pump station 100 to at least one of the openings 116, 117, or a newly formed opening 128, in the enclosure 102 to deposit the Liquid L into the chamber 114 of the wet well 101.

In another embodiment, the piping $P_5$ also can be connected to the closed piping $P_O$ so as to divert input flow F, to the wet well 101, such as using another the diverter valve 169 between input piping $P_1$ alone or in combination with the branch 160 in the modular enclosure 140 to allow for more rapid filling and drainage of the wet well 101 thereof using one or more diverter valves 160, 169.

The technical problem to be solved by the utility model to install a dry well pump station as a new or refurbishment of an existing wet well sufficient to accommodate increased input liquid L input into from ground, wastewater, sewage, sewer rainwater, gravity collection systems, in sewage or other gravity feed piping network, e.g., networks having insufficient capacity to accommodate flooding, or from rainfall in short time periods, SSOs, and/or power outages.

The technical solution adopted by the utility model to solve the above technical problems is as follows: a dry well pump station system, the dry well provides a clean and dry machine room for a direct input pumping system, with diversion valve connected by fail safe piping to a wet well is configured to close the input to the existing wet unless needed for an emergency event, and a control system for controlling the dry well in multiple modes. The control system being configured to include: (1) a normal operating mode adapted to receive liquid input from piping of wastewater processing network and provide liquid output under force to other pipes of the main wastewater processing network; and (2) a fail-safe mode directing the input into the wet well using the diversion valve. For example, in an emergency event, the diversion valve switches to divert input to the wet well through piping of the system upon failure of the primary system due to, e.g., a power outage, and advantageously provides a fail-safe/redundancy operating mode that provides full N+1 redundancy of the pumping station.

The technical solution allows advantageously for increasing the capacity of the gravity feed piping network using a direct input pumping system adapted to receive input from, and to deliver effluent directly to, existing piping by closing the input to the existing wet well unless needed [for] due to an emergency event of an existing wet well. In the event of a power outage or other emergency affecting the dry well pumping system, the wet well is allowed to fill with wastewater. The piping connection can be an existing opening of the wet well enclosure such as, for example, a diversion valve connection to the input piping and/or a return connection to the (former) elevated discharge elevation outlet. Until power is restored to the dry well pumping system, the return connection to the wet well provides overflow capacity as required by the parameters of the sewage network. Once power is restored, any overflow into the wet well of additional sewage or other collected liquids can be pumped out and processed by the dry well pumping station when power is restored or generators brought on-line. In this manner, toilets, drains and other sewage openings in the sewage piping network do not back up as may occur in gravity networks, or from other forces on the liquid, as the liquid is diverted to the wet well. Moreover, the dry well pumping station provides that the pumping system, controls, and valves remain dry during normal pumping operation and/or after emergency events. The technical solution further provides an odorless environment in the enclosure of the pump station that advantageously allows safer entry during normal operations, during power outages, and as may be needed in adverse environmental conditions.

The wet well 101 enclosure 110 may be placed in the Earth, denoted as E, and constructed, for example, from precast concrete sections forming the side walls, base and cover, and/or from a generally unitary circular or cylindrical tank formed from metal, plastics, or fiber-reinforced plastic construction and configured with a hatch opening for access. A conventional wet well 101 installation typically has an enclosure 102 such as, for example, a uniform fiberglass tank and/or a concrete structure. A concrete wet well 101 construction may be configured with a cover slab, one or more walls, e.g., circular, square, rectangular, and/or other wall segment arrangements, a concrete base with the walls operably connected to the base, e.g., by a construction joint or the like, and/or further including a blinding disposed on a sub-base according to known construction codes and structural arrangements. In certain constructions, the piping is connected by flanges and/or collars, designated herein as $C_1$, $C_2$, $C_3$, $C_4$, $C_5$, $C_6$, and $C_7$, as shown throughout FIG. 1, to form connections to the ground piping of a sewage network from the interior of the enclosure, typically on a low pressure line. In certain wet well 101 constructions, an overflow return 106 is provided to allow overflow return 106 such as, for example, from flooding to an adjacent enclosure for a valve network, a cistern, and/or wastewater holding reservoir(s) into the wet well 101, or backflow from other wet wells, for pumping by a submersible pump to the sewage network. The wet well 101 may further be configured with an air vent so as to vent any unwanted gases that may accumulate in the chamber 114.

The dry well pump station system 100 also can be connected between numerous inputs and outputs using valves, e.g., gate valves, in the design such that the input and output may be isolated in one or more branches thereof for maintenance, motor servicing, or replacement thereof. The pumps of the system 100 can be a direct in-line pumping system manufactured under the Overwatch brand by Industrial Flow Solutions Operating LLC of New Haven Connecticut that features a chopper impeller and controls to detect and remove clogs without human intervention. The pumping system can be elevated a height $HW_1$ above the base 113 and a distance $HW_2$ below the outlet 116, or 117, in the enclosure 110 of wet well 101. Similarly, the pumps 148, 149 and/or volutes 150, 151 of the pumping system can be elevated a height $H_1$ above the lower portion 142, e.g. the total depth of the system below the motor flanges/volutes is calculated with an understanding of the critical fluid volume required to hold sewage as promulgated in specifications written by the state, county or city. The predetermined height $H_2$ is the sump well to the outlet 167. The control unit 157 can control and/or monitor a sump pump 158 or otherwise the sump pump can be configured to be operated by the state of a sensor such as a floats 159*a*, 159*b*, 159*c* that detect fluids in the dry well chamber 144 so as to energize the pump and clear the unwanted fluids. The pump station system 100 uses a submersible pump assembly 121, 122 operably connected using piping $P_S$ disposed on the base 113 of the wet well 101 to the input pipeline.

For example, the input piping $P_2$ can connect to piping $P_5$ by the diverter valve 160, with the piping $P_5$ connecting to the input 116 of the wet well at a height $H_2$ that is above the critical elevation in space where sewage may flow into an area that is not desired; i.e., waterway, residential basement, etc. In the event of a system failure or power outage, the diverter valve operably opens to allow flow into the chamber 114 area of the wet well 101. If water level in the wet well 101 system meets a particular critical level, the floats 123, 124 and/or 125 can operably energize at least one of the submersible pumps 122, 123 to pump the sewage out of the wet well chamber 114 before flooding undesirable areas using the piping $P_5$ in a sealed connection to the input piping $P_2$. In an alternative configuration, the overflow volume could be distributed first into the gravity invert or "horizontal wet well" (FIG. 2), and then additional volume can exist beneath a height $H_1$ pump motors 149, 148 enclosed in the modular enclosure 140 thereby providing an efficient refitting of older under-capacity wet wells 101 with advantages for improved efficiency and volumes of pumped liquids L.

Furthermore, when the system 100 returns to normal operations, a suction pump, such as a submersible pump manufactured by BJM and/or an oil detection submersible pump manufactured by Stancor for detecting and holding oil and other contaminants, that is configured to sit within a wet well portion of the system can dewater the basin/chamber without human interaction. This system 100 allows for dry run, odorless pumps stations during normal operation and the emergency volume requirements specified by wet well design guides.

Points of novelty for this apparatus, system, and method may include:

- This system 100 dewaters itself without the need for a vacuum truck or additional pumping apparatus;
- This system 100 reduces the effects of clogging by eliminating solid faction layers and other problems associated with the wet well designs;
- This system 100 has the ability to detect and remove clogs without human interventions; and/or
- This system 100 eliminates odors and the need for odor compression systems.

Points of novelty for this apparatus, system, and method may include:

- A complete kit/system that couples to retrofit wet well or provide as a new station.
- a switch-type valve that, in normal operating mode causes input to feed from main directly to manifold. In redundancy/fail safe mode, valve changes position to cause effluent to be diverted to wet well, wherein it is pumped via a suction pump and rerouted back to discharge pipe until such time as normal operating mode can be reestablished.
- An all-in-one control to provide the logic necessary to perform operating of system
- (1) in all conditions during normal operating mode, (2) fail safe switching upon detection of system failure due to e.g., power outage, and (3) in all conditions during redundancy/fail safe mode, until such time as normal operating mode can be reestablished.

Structural features include:

A frequency inverter for each pump; On—board control panel;

Pump management and/or Remote Control of the dry well pumping station system;

By lifting gravity effluent directly at the point of entry, without water loading or a wet well, the OverWatch® overcomes the drawbacks of retained volumes of effluent:

dangerous gases; smells;

sand and grease accumulation; equipment corrosion;

clogged floaters; and offers access safety.

The structural features of the pumping system 130, identified above, allow:

the pump station to accommodate up to 10% gas being transported within the fluid flow, without running the risk of air-binding;

a continuous and modulated pumping arrangement that handles input on-demand and directly at the input inlet; operation is no longer based on an "all-or-nothing" pumping station;

solid or fibrous matter to move through the system without causing blockages. The structural features of the ALC Panel, identified above, allow:

a high level of integrated protection to the system;

flow regulation, even when flow is highly variable;

for the elimination of valve knocks and water hammer;

constant and regular flow from the effluent inlet, thus avoiding fluids arriving in "batches", which are generally detrimental to the biomass used for biological treatment;

The advantages and benefits of dry well pumping station 100 further include economical, ideal for transportation and installation costs, quick to connect without the need for a valve vault, reduces excavation depth required, enables future modifications to be made, robust, waterproof, non-porous, with no fragile tank adapters, resistance to ground settlement, poor backfilling, impacts during installation, and stress caused when pouring the upper concrete slab, sustainable, corrosion and erosion resistance prevents systems from degrading over time, ecological designed with non-oil-based products.

While certain configurations of structures have been illustrated for the purposes of presenting the basic structures of the present invention, one of ordinary skill in the art will appreciate that other variations are possible which would still fall within the scope of the appended claims. Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A pump station for pumping an input flow $F_I$ in pipes of a gravity feed network, the pump station comprising:

an enclosure formed in a contiguous shape having an upper portion, lower portion and at least one side portion forming a dry well chamber, said side portion having an inlet opening and one or more outlet openings, said upper portion configured with a hatch assembly to provide access to said dry well chamber, said lower portion further comprising a sump well, and said dry well chamber is formed with a sufficient dimension to provide space for a pumping system;

a pumping system located in said dry well chamber, said pumping system comprising controls, motors, pumps and a branched piping $P_B$ assembly, said branched piping $P_B$ assembly configured to be operably connected to an input flow $F_I$ and to one or more pumps;

an inlet piping P2 operably connecting Flow F1 from a gravity feed piping network, said inlet piping P2 adapted to operably connect Flow F1 input flow FI to said branched piping PB;

an outlet piping P3 operably connected to the output of said branched piping PB and/or said one or more pumps, said outlet piping P3 configured to receive output Flow FO from said one or more pumps of said pumping system;

a diverted piping $P_5$ configured to convey a first flow $F_1$ diverted by a diversion valve from said inlet piping $P_2$ to a wet well; and a control unit operably connected to a power source and to said pumping system for controlling said one or more pumps.

2. The pump station of claim 1 wherein said pumping system further comprises a sump pump disposed in said sump well and coupled to said inlet piping $P_2$ downstream of said diversion valve by a sump piping $P_9$.

3. The pump station of claim 2 further comprising a plurality of gate valves, at least one upstream gate valve operably connected between said inlet piping $P_2$ and branched piping $P_B$ of said pumping system adapted to connect and/or disconnect said branched piping from the Flow input flow $F_I$, and at least one downstream gate valve operably connected between an output outlet of said pumping system and said outlet piping $P_3$.

4. The pump station of claim 3 further comprising a return piping $P_{10}$ coupled to an outlet of said wet well on one end and to said inlet piping $P_2$ on the other.

* * * * *